US009715799B2

(12) United States Patent
Joseph et al.

(10) Patent No.: US 9,715,799 B2
(45) Date of Patent: Jul. 25, 2017

(54) SYSTEM AND METHOD OF USING A FIRE SPREAD FORECAST AND BIM TO GUIDE OCCUPANTS USING SMART SIGNS

(71) Applicant: Honeywell International Inc., Morristown, NJ (US)

(72) Inventors: Vibgy Joseph, Tirunelveli (IN); Sakthi Prakash Marakkannu, Madurai (IN); Balaji Bhathey Sivakumar, Madurai (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 14/885,471

(22) Filed: Oct. 16, 2015

(65) Prior Publication Data

US 2017/0109981 A1 Apr. 20, 2017

(51) Int. Cl.

| | |
|---|---|
| ***G08B 17/00*** | (2006.01) |
| ***G08B 7/06*** | (2006.01) |
| ***G08B 17/10*** | (2006.01) |

(52) U.S. Cl.

CPC ..... *G08B 7/062* (2013.01); *G08B 17/10* (2013.01)

(58) Field of Classification Search

CPC ..... G08B 7/062; G08B 7/066; G08B 17/00; G08B 17/10

USPC ..... 340/584, 577, 628, 539.27, 524, 525; 702/130; 700/299

See application file for complete search history.

(56) References Cited

U.S. PATENT DOCUMENTS

| | | | | |
|---|---|---|---|---|
| 7,286,050 | B2 | 10/2007 | Faltesek | |
| 2002/0029129 | A1* | 3/2002 | Satoh | G06F 17/5004 702/182 |
| 2009/0128327 | A1* | 5/2009 | Lang | G08B 17/00 340/584 |
| 2011/0112660 | A1* | 5/2011 | Bergmann | G08B 7/066 700/29 |
| 2015/0287295 | A1* | 10/2015 | Trivelpiece | G08B 7/062 340/6.1 |
| 2015/0309895 | A1* | 10/2015 | Tanimoto | H04L 67/22 714/4.11 |
| 2016/0266556 | A1* | 9/2016 | Pearson | G05B 13/04 |

FOREIGN PATENT DOCUMENTS

| | | |
|---|---|---|
| WO | WO 2005/050953 A2 | 6/2005 |
| WO | WO 2005/052873 A2 | 6/2005 |

* cited by examiner

*Primary Examiner* — Thomas Mullen
(74) *Attorney, Agent, or Firm* — Husch Blackwell LLP

(57) ABSTRACT

Systems and methods of using a fire spread forecast and BIM to guide occupants using smart signs are provided. Some methods can include receiving a first signal indicative of a first location of a fire event in a monitored region, using the first location and BIM information to project an area into which the fire event will spread in the monitored region, and identifying at least one smart sign in the monitored region to enable for guiding an occupant in the monitored region to an exit door in the monitored region while avoiding the first location and the area.

20 Claims, 4 Drawing Sheets

SYSTEM AND METHOD OF USING A FIRE SPREAD FORECAST AND BIM TO GUIDE OCCUPANTS USING SMART SIGNS

FIELD

The present invention relates generally to access control systems and methods. More particularly, the present invention relates to systems and methods of using a fire spread forecast and BIM to guide occupants using smart signs.

BACKGROUND

Access control systems can play a vital role in securing different regions inside of a building or other facility. However, when a fire occurs inside of the building, an exit from the building may be blocked by the fire.

A large building may include many exits, and occupants can be spread widely throughout the building. Indeed, there may be many ways for an occupant to exit the building from his current location. However, some exits may be safe, and some may not be safe. For example, while trying to exit the building, an occupant may head towards an exit blocked by a fire, not knowing about the blockage. Moreover, the fire may spread and block more exits over time.

Known access control systems include fire emergency alai us that are passive and fire exit signs that are static. Accordingly, as explained above, a fire exit sign may lead an occupant of a building to an unusable exit or an area consumed by fire. However, there are no known systems and methods that enable or disable fire exit signs based on the location and spread of fire in a building.

In view of the above, there is a continuing, ongoing need for improved systems and methods.

DETAILED DESCRIPTION

Figure 1:
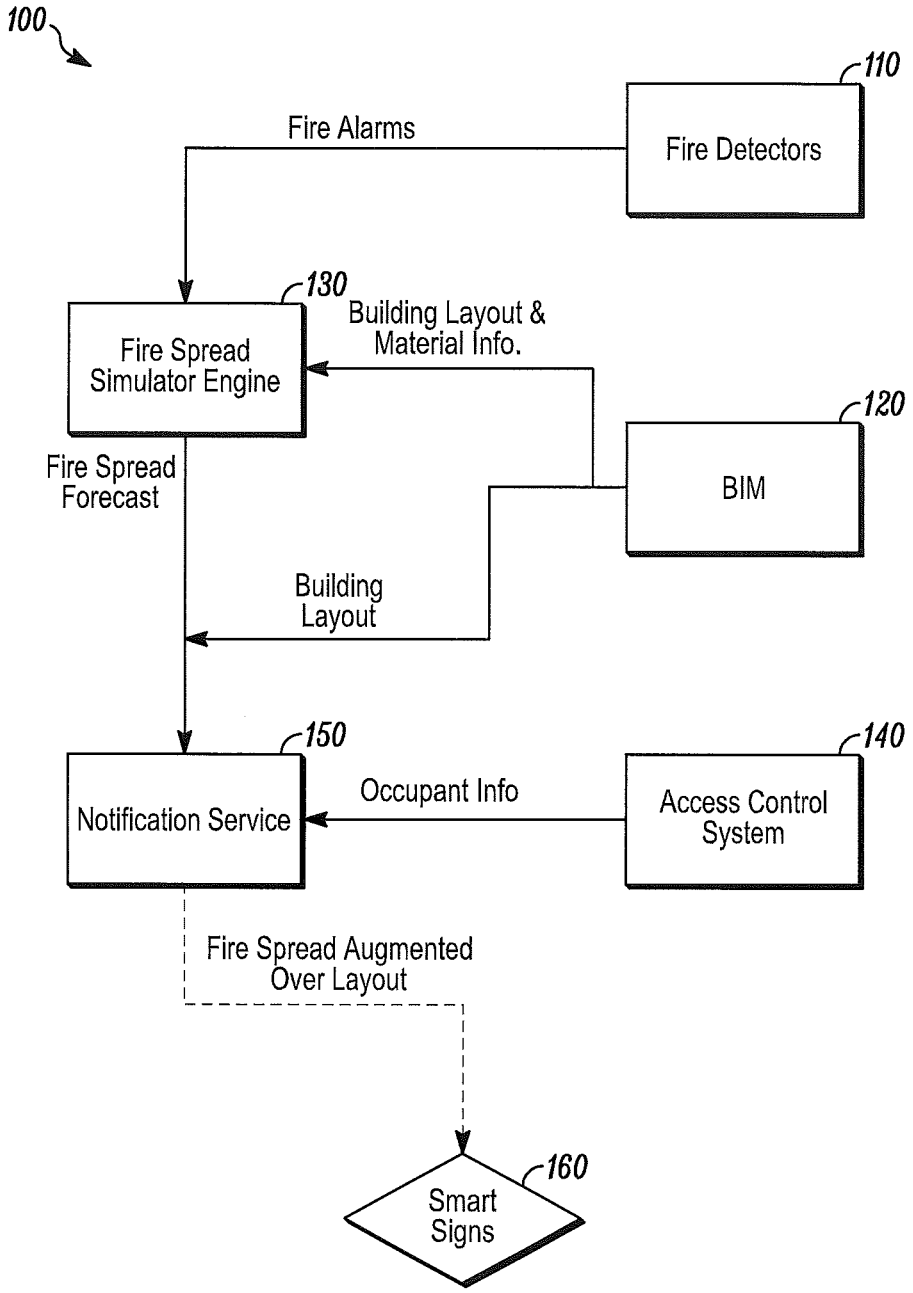
FIG. 1 is a flow diagram of a method in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein include systems and methods of using a fire spread forecast and building information modeling (BIM) to guide occupants using smart signs. For example, in some embodiments, systems and methods disclosed herein can utilize at least some of BIM information, fire sensor data, access control system events, dynamic smart signs, beacon devices, or WiFi triangulation methods to identify the location of a fire in the building, to predict the spread of the fire, to identify the location of occupants in the building when applicable and available, and to enable a dynamic smart sign to safely guide the occupants out of the building.

For example, in some embodiments, systems and methods disclosed herein can identify the location of a fire in a building based on information received from fire sensors and the like and, using BIM information, simulate the spread of the fire to predict the direction of such a spread. In some embodiments, systems and methods disclosed herein can also identify the coordinates of occupants in the building when applicable and available, for example, by employing a location identifying system, such as an access control system, by employing WiFi triangulation methods, or based on beacons from users' smart phones, WiFi access points, RFID scanners, and the like. Then, based on at least some of the location of the fire, the predicted spread of the fire, the location of occupants in the building when applicable and available, access control system configuration data, and BIM information, systems and methods can sequentially enable and disable dynamic smart signs in the building to guide occupants on a safe path to exit the building while avoiding the fire and the spread thereof.

As explained above, in some embodiments, systems and methods disclosed herein can use BIM information to predict the direction of the spread of a fire. For example, the BIM information can include information regarding the layout of the building and information regarding the material properties of walls, floors, doors, and the like in the building. As further explained above, in some embodiments, systems and methods disclosed herein can use BIM information to guide occupants on a safe path to exit the building. For example, the BIM information can include information about walkways that are available for occupants to traverse in the building.

The dynamic smart signs disclosed herein can be enabled or activated as described above and herein. When enabled, a smart sign can guide an occupant to a safe exit of a building by advising the occupant that the area in the vicinity of the enabled smart sign is safe for the occupant or is not safe for the occupant. In some embodiments, the smart signs disclosed herein can be integrated with access control systems or other building automation systems known in the art.

It is to be understood that systems and methods disclosed herein can be used in connection with smart devices, such as smart phones, wearable smart devices, and the like. In this regard, U.S. application Ser. No. 14/810,030 filed Jul. 27, 2015 and titled "Individual Evacuation Plan Generation and Notification via Smart/Wearable Devices by Positioning and Predicting Emergencies Inside A Building" is assigned to the assignee hereof and is hereby incorporated by reference.

FIG. 1 is a flow diagram of a method 100 in accordance with disclosed embodiments. As seen in FIG. 1, the method 100 can include receiving input from fire detectors in a building as in 110 and receiving input from a BIM device as in 120. For example, the information from the fire detectors can include information about the location of a detected fire in the building, and the BIM information can include information regarding the building's layout and materials of walls, floors, doors, and the like in the building.

The method 100 can use the input received as in 110 and 120 to calculate, determine, identify, estimate, project, or simulate the spread of the detected fire as in 130. For example, the method 100 can simulate fire spread vectors that include a projected direction and trajectory of the fire. As seen in FIG. 1, the method 100 can use the fire spread simulated as in 130, the BIM information received as in 120, including the building's layout, and, when applicable and available, the location of occupants in the building received as 140 to identify smart signs in the building to enable or disable as in 150. For example, in some embodiments, the method 100 can include receiving input from a location identifying system to identify the location of occupants in the building as in 140.

It is to be understood that the location identifying system can include an access control system, a user's smart phone acting as a beacon, a WiFi access point, and the like. However, it is to be understood that embodiments disclosed herein are not so limited. Instead, a location identifying system can include any such system as would be known or desired by one of ordinary skill in the art, and the method 100 can identify the location of occupants in the building in any manner as would be known or desired by one of ordinary skill in the art.

It is also to be understood that the method 100 can identify smart signs in the building to enable or disable as in 150 with or without receiving the location of occupants in the building as in 140. For example, in some embodiments, the method 100 can identify smart signs to enable or disable as in 150 regardless of the location of occupants in the building, regardless of whether there are any occupants in the building, and regardless of whether any occupants in the building are identified. Indeed, an occupant can be located in the building, but the location thereof may not be detected or identified. In these situations, the method 100 can still identify smart signs in the building to enable or disable as in 150, and the undetected or unidentified occupant can view the same.

Figure 2:
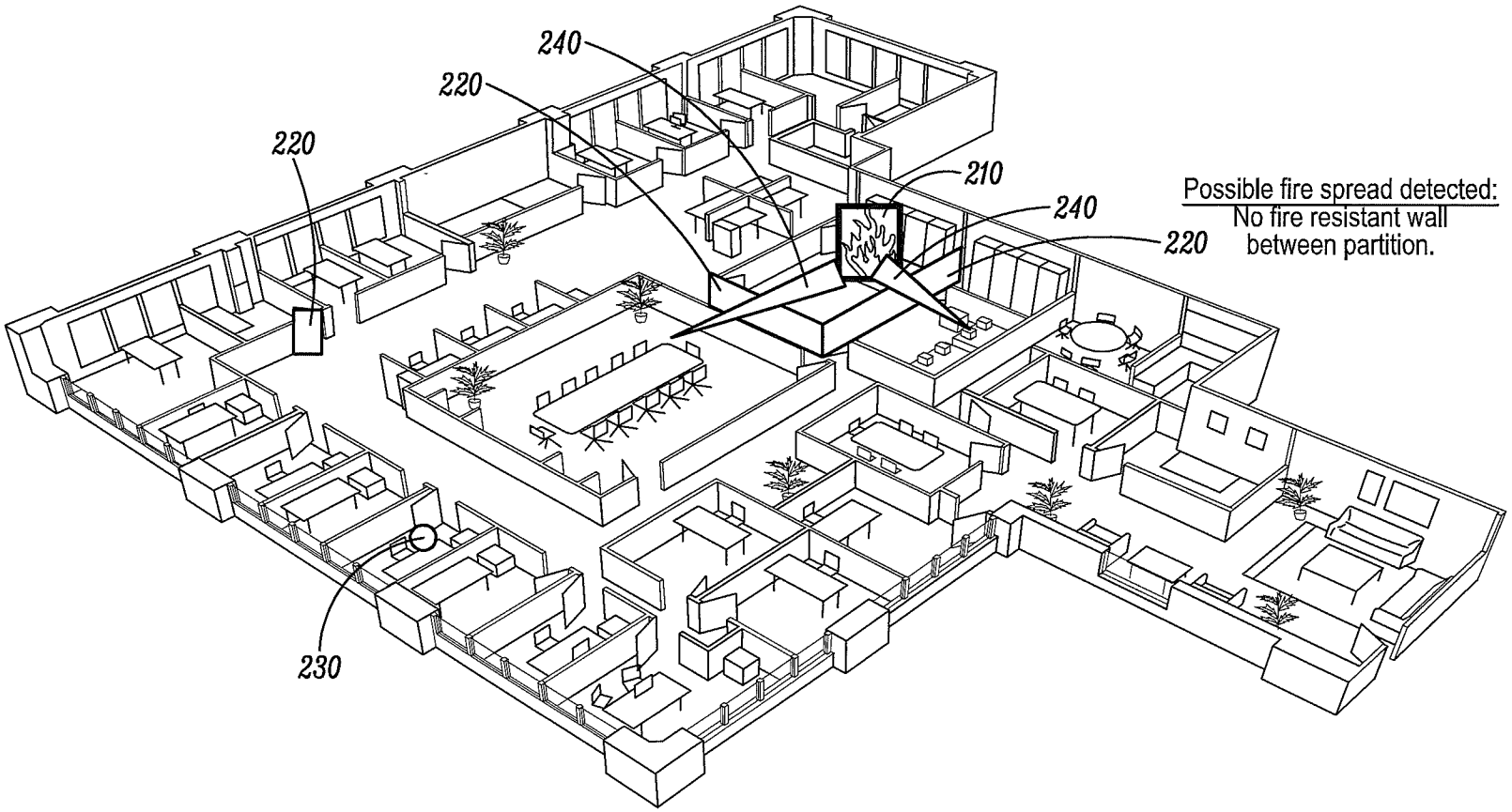
FIG. 2 is a perspective view of a floor plan of a floor in a monitored building in accordance with disclosed embodiment.

FIG. 2 is a perspective view of a floor plan of a floor in a monitored building in accordance with disclosed embodiments. As seen in FIG. 2, systems and methods can identify the location of a detected fire 210 on the floor plan based on information from fire detectors on the floor. Systems and methods can also identify non-fire resistant walls and doors 220 on the floor based on BIM information. Finally, when applicable and available, systems and methods can identify the location of an occupant 230 on the floor based on a signal from the occupant's smart phone, an access point, or another access control system device on the floor. Based on some or all of the identified information, systems and methods can simulate fire spread vectors 240 to simulate the projected direction and trajectory of the detected fire 210.

As seen in FIG. 1, after the method 100 identifies smart signs in the building to enable or disable as in 150, the method 100 can transmit signals to enable or disable the relevant smart signs as in 160. Indeed, because the smart signs are enabled and disabled based on at least some of the information described above and herein, the information provided by the smart signs can be accurate, even in emergency situations.

Figure 3B:
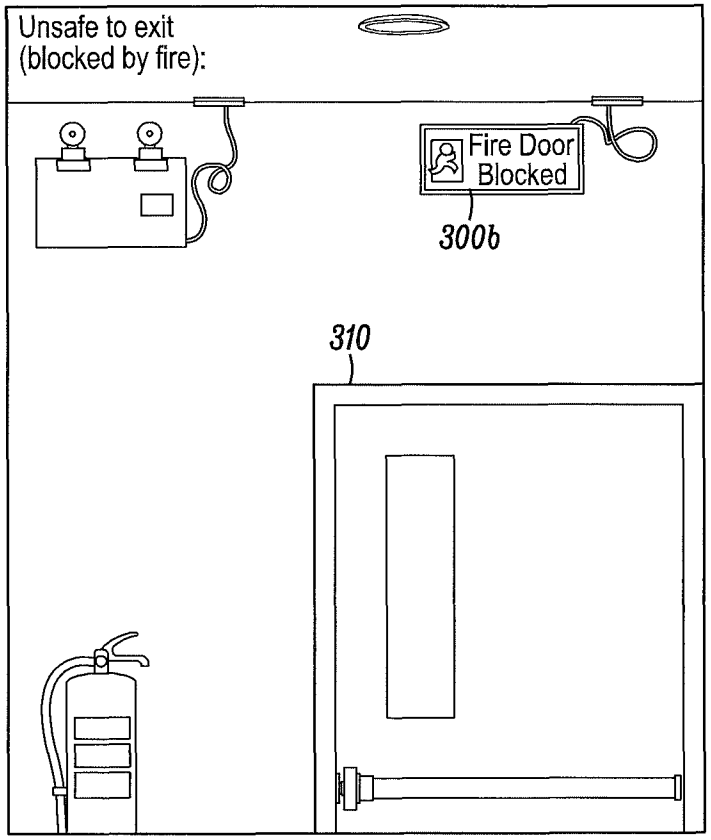
FIG. 3B is a plan view of a smart fire exit sign in the vicinity of an exit door of a building and in accordance with disclosed embodiments.
Figure 3A:
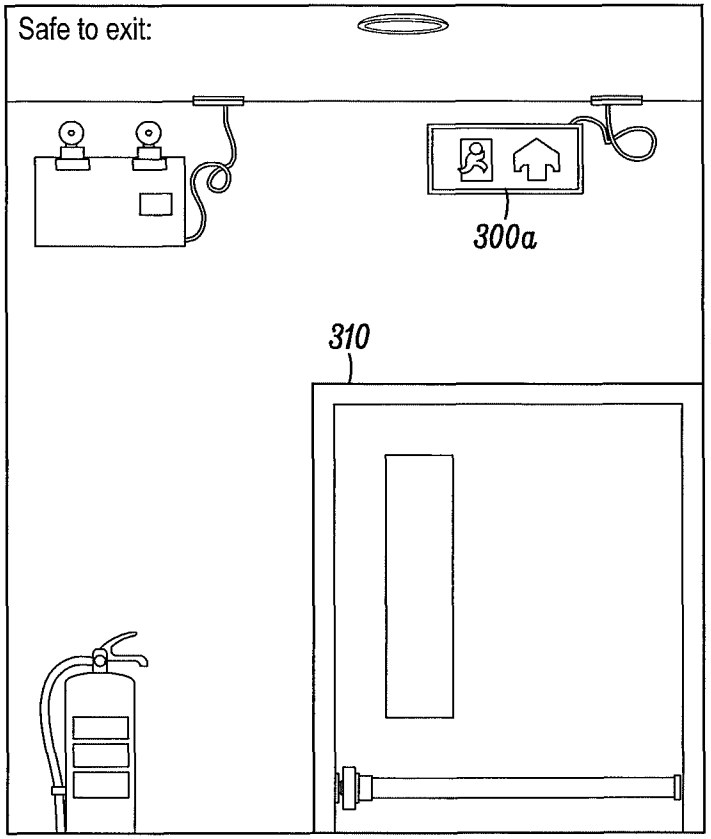
FIG. 3A is a plan view of a smart fire exit sign in the vicinity of an exit door of a building and in accordance with disclosed embodiments.

FIG. 3A and FIG. 3B are plan views of smart fire exit signs 300*a*, 300*b* in the vicinity of an exit door 310 of a building and in accordance with disclosed embodiments. As seen in FIG. 3A, based on a received signal, the smart sign 300*a* can be enabled with lights, diagrams, words, or the like to indicate that the exit door 310 is safe for a building occupant to exit. Conversely, as seen in FIG. 3B, based on a received signal, the smart sign 300*b* can be enabled with lights, diagrams, words, or the like to indicate that the exit door 310 is not safe for a building occupant to exit. Alternatively, in some embodiments, a smart sign can be disabled or simply not receive a signal for the sign to indicate that a nearby exit door is unsafe.

In some embodiments, systems and methods disclosed herein can determine that all available exits from a building are unsafe for an occupant. For example, the building may only have one door, and that door might be blocked by a detected fire. Similarly, all doors in the building might be blocked by a detected fire or on the path of a projected fire spread trajectory. In these embodiments, systems and methods disclosed herein can use BIM information to identify a breakable window nearest the occupant of the building and transmit a signal or other indication to a user with instructions for breaking the window and exiting the building therefrom.

Figure 4:
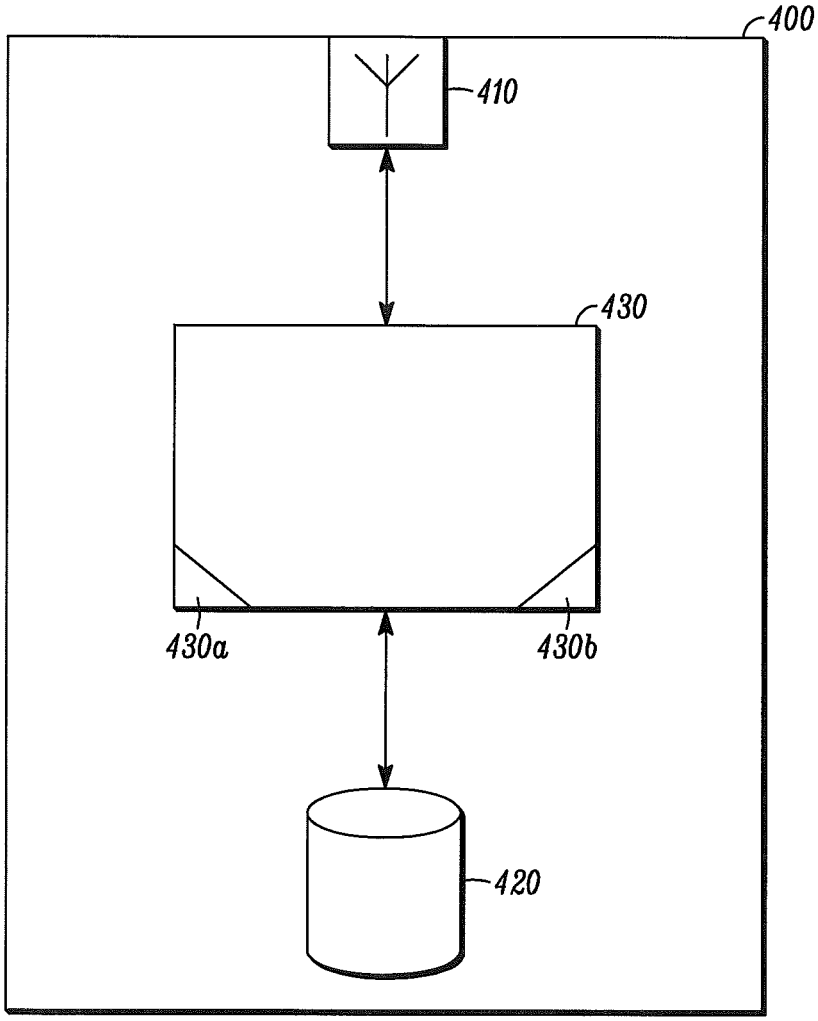
FIG. 4 is a block diagram of a system in accordance with disclosed embodiments.

FIG. 4 is a block diagram of a system 400 in accordance with disclosed embodiments. For example, the system 400 can include a transceiver 410, a memory device 420, control circuitry 430, one or more programmable processors 430*a*, and executable control software 430*b* as would be understood by one of ordinary skill in the art. The executable control software 430*b* can be stored on a transitory or non-transitory computer readable medium, including, but not limited to local computer memory, RAM, optical storage media, magnetic storage media, flash memory, and the like. In some embodiments, the control circuitry 430, the programmable processors 430*a*, and the executable control software 430*b* can execute and control the methods described above and herein.

For example, the wireless transceiver 410 can communicate with at least some of fire detectors and sensors, BIM devices, access control systems, access points, smart phones, and smart signs in a monitored region via wired or wireless communication paths. Based on at least some of the information received by the transceiver 410, the control circuitry 430, the programmable processor 430*a*, and the executable control software 430*b* can simulate fire spread vectors and identify smart signs to enable or disable. The control circuitry 430, the programmable processor 430*a*, and the executable control software 430*b* can also instruct the transceiver 410 to transmit corresponding signals to smart signs in the region. In some embodiments, BIM information and the like for a respective monitored region can be stored in the memory device 420 and accessed by the control circuitry 430, the programmable processor 430*a*, and the control software 430*b* as needed.

The systems and methods described above can be used in connection with any building or facility as would be known and desired by one of ordinary skill in the art. However, such systems and methods are advantageously used in connection with large buildings and facilities, such as airports, large industrial spaces, and multi-story commercial or residential buildings, such as shopping malls.

It is to be understood that in addition to assisting occupants of a building to safely exit the building, systems and methods disclosed herein can also assist rescue teams and first responders to extinguish fires or other alarm events or to reach potential victims efficiently, effectively, and proficiently.

Finally, it is to be understood that systems and methods disclosed herein can be used in connection with designing a building or other facility. For example, systems and methods disclosed herein can simulate scenarios with different and various fire and occupant locations in a building and determine optimal placement for fire exits based on the different scenarios.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

receiving a first signal indicative of a first location of a fire event in a monitored region;

using the first location and building information modeling (BIM) information to project an area into which the fire event will spread in the monitored region; and identifying at least one smart sign in the monitored region to enable for guiding an occupant in the monitored region to an exit door in the monitored region while avoiding the first location and the area.

2. The method of claim 1 further comprising receiving the first signal from a fire detector in the monitored region.

3. The method of claim 1 further comprising receiving the BIM information from a BIM device.

4. The method of claim 1 further comprising retrieving the BIM information from a database device.

5. The method of claim 1 further comprising using the first location and the BIM information to simulate fire spread vectors for the fire event.

6. The method of claim 1 further comprising:

receiving a second signal indicative of a second location of the occupant in the monitored region; and identifying the at least one smart sign in the monitored region to enable for guiding the occupant from the second location to the exit door in the monitored region while avoiding the first location and the projected area into which the fire event will spread.

7. The method of claim 1 further comprising transmitting a second signal to the at least one smart sign to enable the at least one smart sign.

8. The method of claim 1 further comprising identifying at a second smart sign in the monitored region to disable.

9. The method of claim 1 further comprising:

identifying the at least one smart sign from a plurality of smart signs in the monitored region to enable; and transmitting a second signal to the at least one smart sign.

10. A system comprising:

a transceiver;

a programmable processor; and executable control software stored on a non-transitory computer readable medium, wherein the transceiver receives a first signal indicative of a first location of a fire event in a monitored region, wherein the programmable processor and the executable control software use the first location and building information modeling (BIM) information to project an area into which the fire event will spread in the monitored region, and wherein the programmable processor and the executable control software identify at least one smart sign in the monitored region to enable for guiding an occupant in the monitored region to an exit door in the monitored region while avoiding the first location and the area.

11. The system of claim 10 wherein the transceiver receives the first signal from a fire detector in the monitored region.

12. The system of claim 10 wherein the transceiver receives the BIM information from a BIM device.

13. The system of claim 10 further comprising a database device, wherein the programmable processor and the executable control software retrieve the BIM information from the database device.

14. The system of claim 10 wherein the programmable processor and the executable control software use the first location and the BIM information to simulate fire spread vectors for the fire event.

15. The system of claim 10 wherein the transceiver receives a second signal indicative of a second location of the occupant in the monitored region, and wherein the programmable processor and the executable control software identify the at least one smart sign in the monitored region to enable for guiding the occupant from the second location to the exit door in the monitored region while avoiding the first location and the area.

16. The system of claim 10 wherein the programmable processor and the executable control software instruct the transceiver to transmit a second signal to the at least one smart sign to enable the at least one smart sign.

17. The system of claim 10 wherein the programmable processor and the executable control software identify a second smart sign in the monitored region to disable.

18. The system of claim 10 wherein the programmable processor and the executable control software identify the at least one smart sign from a plurality of smart signs in the monitored region to enable and instruct the transceiver to transmit a second signal to the at least one smart sign.

19. A system comprising:

a fire detection system in a monitored region;

a building information modeling (BIM) device;

a simulator and notification system; and a plurality of smart signs in the monitored region, wherein the simulator and notification system receives a first signal from the fire detection system and a second signal from the BIM device, wherein the simulator and notification system uses the first signal and the second signal to project an area into which a fire event detected by the fire detection system will spread in the monitored region, and wherein the simulator and notification system uses the first signal, the second signal, and the area to identify at least one of the plurality of smart signs to enable for guiding an occupant in the monitored region to an exit door in the monitored region while avoiding a location of the fire event and the area.

20. The system of claim 19 wherein each of the plurality of smart signs includes at least one light that can be enabled or disabled or at least one diagram or word that can be displayed or hidden.

* * * * *